United States Patent [19]

Yukawa et al.

[11] Patent Number: 5,057,812

[45] Date of Patent: Oct. 15, 1991

[54] NOISE-SUPPRESSING HIGH-TENSION RESISTANCE CABLE

[75] Inventors: Yoshimi Yukawa; Toshio Inada; Akira Ikegaya, all of Shizuoka, Japan

[73] Assignee: Yazaki Corporation, Tokyo, Japan

[21] Appl. No.: 597,238

[22] Filed: Oct. 15, 1990

[30] Foreign Application Priority Data

Nov. 16, 1989 [JP] Japan ..... 1-296175

[51] Int. Cl.[5] ..... H01B 7/00; H01C 7/00

[52] U.S. Cl. ..... 338/66; 338/214; 174/120 R

[58] Field of Search ..... 338/66, 214; 174/102 C, 174/102 SC, 120 R, 120 SC, 120 SR

[56] References Cited

U.S. PATENT DOCUMENTS

| | | | |
|---|---|---|---|
| 3,109,881 | 11/1963 | Publow . | |
| 3,284,751 | 11/1966 | Barker et al. . | |
| 3,492,622 | 1/1970 | Hayashi et al. . | |
| 3,518,606 | 6/1970 | Barker . | |
| 4,800,359 | 1/1989 | Yukawa et al. | 338/214 |
| 4,970,488 | 11/1990 | Horiike et al. | 338/214 |

FOREIGN PATENT DOCUMENTS

| | | |
|---|---|---|
| 56-107410 | 8/1981 | Japan . |
| 56-112817 | 8/1981 | Japan . |
| 56-112818 | 8/1981 | Japan . |
| 56-112819 | 8/1981 | Japan . |
| 56-114224 | 9/1981 | Japan . |
| 57-9008 | 1/1982 | Japan . |
| 57-33023 | 2/1982 | Japan . |
| 58-103415 | 7/1983 | Japan . |
| 61-687 | 1/1986 | Japan . |
| 61-1844 | 1/1986 | Japan . |
| 62-23409 | 5/1987 | Japan . |
| 63-69107 | 3/1988 | Japan . |
| 64-7721 | 1/1989 | Japan . |
| 1-43967 | 9/1989 | Japan . |

*Primary Examiner*—Marvin M. Lateef

*Attorney, Agent, or Firm*—Sughrue, Mion, Zinn, Macpeak & Seas

[57] ABSTRACT

A high-tension resistance cable capable of maintaining a distributed capacitance not greater than 80 pF/m while having an outer diameter not greater than 5 mm includes a central resistance conductor which is no more than 0.8 mm in diameter. In one embodiment, the resistance is formed of a reinforcement core, a ferrite core layer, and a metal winding layer. In the metal winding layer, wires, having an outer diameter of 0.04 to 0.045 mm, are wound at a density of 91–115 times per centimeter around the ferrite core layer.

9 Claims, 3 Drawing Sheets

NOISE-SUPPRESSING HIGH-TENSION RESISTANCE CABLE

BACKGROUND OF THE INVENTION

This invention relates to a noise-suppressing high-tension resistance cable (hereinafter referred to as an "ignition cable") for suppressing noise, produced by an electronic ignition of an internal combustion engine of an automobile or the like, which propagates through the air via the cable.

In a conventional ignition cable, in order to prevent such electromagnetic noise wave troubles, and also to prevent an undesired voltage drop from developing when the cable is subjected to water, it has been required that the resistivity of the conductor be about 16 kΩ/m, and that the capacitance be not more than 80 pF/m. The overall outer diameter of an ignition cable having such resistivity and capacitance is usually is 7 mm or 8 mm.

Japanese Patent Application Unexamined Publication No. 107410/81 discloses a cable shown in FIG. 6, which meets the above requirements. In this cable, the outer diameter of a resistance conductor a is not more than 1.2 mm. A semi-conductive layer composed of an inner semi-conductive layer c, a separation layer d, and an outer semi-conductive layer e is formed around a tension member b composed of an aramid fiber bundle. An insulator layer f outside the semi-conductive layer is made of crosslinked polyethylene or a crosslinked blend containing polyethylene. With this construction, the capacitance is not more than 80 pF/m. A reinforcement layer g and a protective sheath layer h are disposed, in that order, around the insulator layer f.

The conventional ignition cable shown in FIG. 6 meets the requirement that the capacitance be not more than 80 pF/m, since the outer diameter of the cable is 7 mm or 8 mm. However, such an ignition cable with an outer diameter of not more than 5 mm which has been developed to meet recent lightweight and small-diameter requirements does not meet the capacitance requirement.

Further, noise suppression regulations for automobiles in Europe and other countries have become more strict, and sufficient noise suppression effect cannot be achieved merely by forming the inner and outer semi-conductive layers c and e by a solid method or a carbon coating dipping method.

In connection with the method of forming the resistance conductor a, it has been required that the resistivity be less varied by a high temperature atmosphere, a thermal cycle during the actual running of the automobile, and physical variations such as vibration and bending.

SUMMARY OF THE INVENTION

In view of the above problems it is one object of the invention to provide an ignition cable with an outer diameter of not more than 5 mm which can keep a distributed capacitance to not more than 80 pF/m when the cable is subjected to water, and can suppress a variation of the resistivity during the actual running of the automobile to within a range of ±5%.

According to the present invention, this object has been achieved by a noise-suppressing high-tension resistance cable comprising a resistance conductor, an insulator layer, and a protective sheath layer wherein the resistance conductor is constituted by a reinforcement core, a ferrite core, and a metal winding layer, and has an outer diameter of not more than 0.8 mm, the capacitance of the resistance conductor being not more than 80 pF/m, an outer diameter of the cable being not more than 5 mm.

In order to achieve the flame retardancy of the ignition cable and to decrease the capacitance, it is preferred that the insulator layer according to the present invention be made of a flame-retardant ethylenepropylene copolymer (EPR or EPDM) having a relatively low dielectric constant.

Preferably, in order to enhance the noise suppressing effect of the ignition cable, the ferrite core (the magnetic material of the conductor) should have a high permeability $\mu$, a low volume specific resistance, and a cold-temperature resistance.

For this reason, it is preferred that the base material for the ferrite core be composed of silicone rubber and fluororubber blended together in a weight ratio of 4:6 to 1:9, such rubbers being mixable well with the magnetic powder and having excellent moldability, flexibility, thermal resistance, and cold-temperature resistance.

In order to enhance the noise suppressing effect by decreasing the radiation power developing at the time of ignition spark and by increasing the eddy current loss affecting the Joule heat exchange (loss), it is preferred that the magnetic material have a high permeability, a high flux density, a high hysteresis loss coefficient, and a high relative loss coefficient.

For this reason, the ferrite core contains 200 to 400 parts by weight of one or more kinds of Mn-Zn type ferrite powder, added to 100 parts by weight of the base material, the ferrite powder having a particle size of not more than 100 $\mu$m, and AC initial magnetic permeability of not less than 2500. a saturated flux density of not less than 4000 Gauss and a relative loss coefficient of not less than $4\times10^{-6}$.

Further, in order to decrease the volume specific resistivity of the magnetic material of the conductor, the ferrite core contains not more than 20 parts by weight of carbon fiber (preferably, vapor phase grown carbon fiber), added to 100 parts by weight of the base material.

DETAILED DESCRIPTION OF THE PREFERRED EMBODIMENT

The above construction will now be described in detail with reference to the drawings showing a preferred embodiment of the invention.

Figure 1:
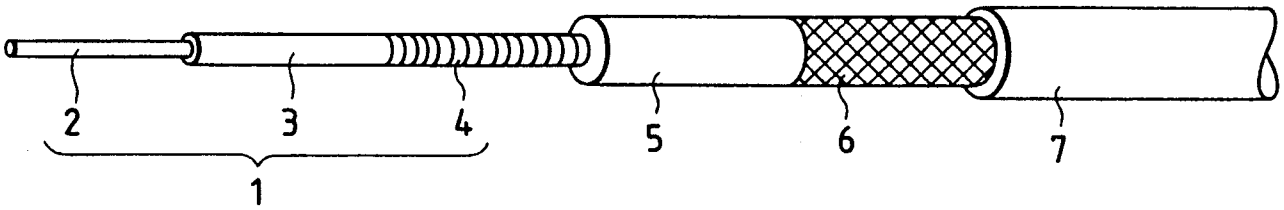
FIG. 1 is a partly broken, perspective view of a preferred embodiment of a noise suppressing high-tension resistance cable (ignition cable) of the invention.
Figure 2:
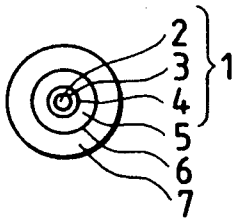
FIG. 2 is a cross-sectional view of the cable.

In FIGS. 1 and 2, a resistance conductor 1 includes a reinforcement core 2 braided of four filaments (400 denier) or formed by twisting such filaments in an S-Z fashion. The outer surface of the reinforcement core 2 is coated with an adhesive-type acryl resin, and the reinforcement core 2 is formed with the acryl resin so as to have an outer diameter of 0.4 to 0.45 mm.

400 parts by weight of Ferrite powder (1) (shown in Table 2 below) is added to 100 parts by weight of a blend base material composed of silicone rubber and fluororubber blended in a ratio of 7:3. The material resulting from this addition is extruded and vulcanized onto the reinforcement core 2 to form a ferrite core layer 3 thereon. At this time, in order to make the capacitance of the ignition cable be not more than 80 pF/m, the outer diameter of the ferrite core layer 3 is formed so as to be 0.65 to 0.7 mm.

Then, a Ni-Cr alloy wire (JIS:NCHW-1) with an outer diameter of 0.04 to 0.045 mm is wound 91 to 115 times per cm around the ferrite core layer 3 to form a metal winding layer 4 thereon. In order to prevent displacement of the alloy wire, it is preferred that about one-third of the outer diameter of the alloy wire be bitten or embedded in the ferrite core layer 3. In this manner, a metal winding-type resistance conductor 1 is formed having an outer diameter of not more than 0.8 mm and a resistivity of 16 kΩ/m.

A coating material of EPDM or flame-retardant EPDM having a dielectric constant of not more than 2.54 is extrusion-coated on the resistance conductor 1 to form an insulator layer 5 thereon, the outer diameter of the insulator layer 5 being not more than 3.8 mm.

Further, in order to increase not only the strength of bonding between a terminal (not shown) and the cable, but also a cable rupture strength when press-connecting the terminal to the cable, a reinforcement layer 6 is formed, the reinforcement layer 6 being made of glass fibers braided at a density of 5 to 9 meshes per inch.

A sheath material, made for example of silicone rubber or flame-retardant EPDM having a protective function, is extruded and vulcanized on the reinforcement layer 6 to form a sheath layer 7 thereon, thereby providing an ignition cable with an outer diameter of 5 mm. In order to enhance the intimate contact between the reinforcement layer 6 and the sheath layer 7, a primer preferably is applied to the reinforcement layer 6.

The reason that the outer diameter of the resistance conductor 1 is not more than 0.8 mm now will be described.

Figure 3:
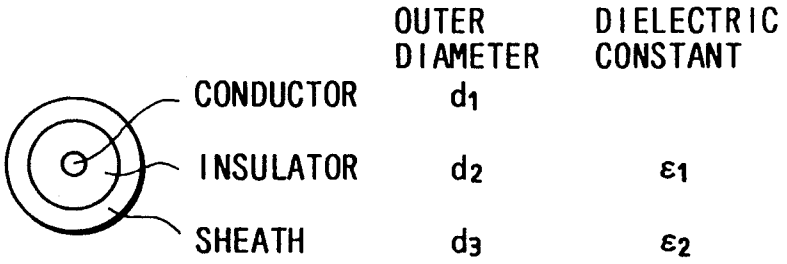
FIG. 3 is a view explanatory of the calculation of the capacitance of the cable.

The capacitance of a cable shown in FIG. 3 is expressed generally by the following formula (1):

$$C = \frac{2\pi\epsilon_o}{\frac{1}{\epsilon_1}\ln\frac{d_2}{d_1} + \frac{1}{\epsilon_2}\ln\frac{d_3}{d_2}} \quad (1)$$

wherein d1, d2 and d3 represent the outer diameters of the conductor, the insulator and the sheath, respectively, and $\epsilon_0$, $\epsilon_1$, and $\epsilon_2$ represent a dielectric constant of the vacuum and relative dielectric constants of the insulator and the sheath, respectively.

In formula (1). in order to decrease the capacitance C, it is effective to decrease the relative dielectric constants of the materials, to reduce the outer diameter of the conductor, and to increase the outer diameters of the insulator and the sheath.

Here, in order to limit the outer diameter of the ignition cable to 5 mm and also to satisfy its general characteristics (e.g. voltage resistance, thermal resistance, etc.). it is important to decrease the outer diameter $d_1$ of the conductor and the relative dielectric constant $\epsilon_1$ of the insulator to the greatest extent possible.

Figure 4:
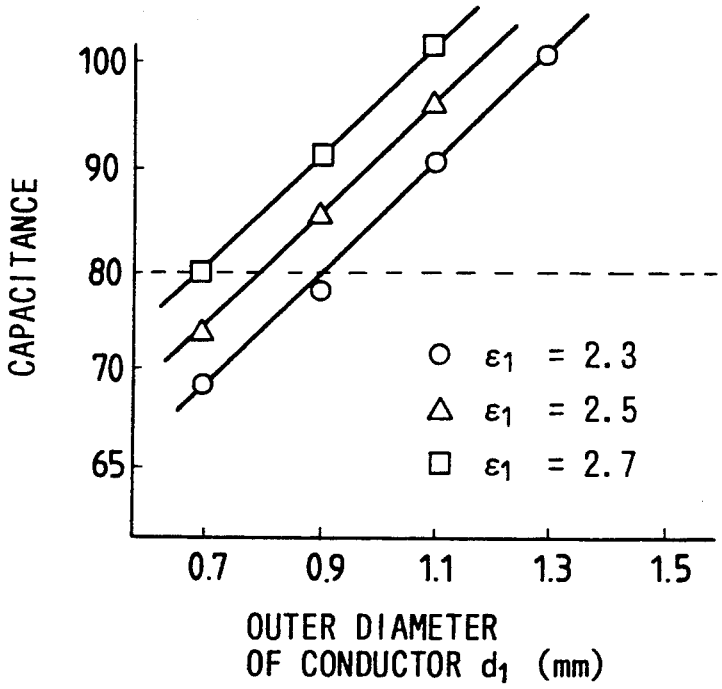
FIG. 4 is a graph showing the relation between an outer diameter of a conductor and a capacitance, with a relative dielectric constant used as a parameter.
Figure 6:
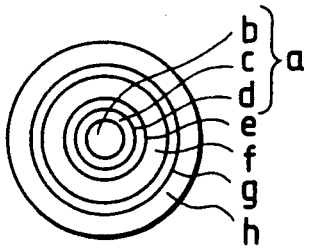
FIG. 5 is a graph showing the relation between the frequency and the electric field intensity in the cable of the invention and a conventional cable and FIG. 6 is a cross-sectional view of a conventional ignition cable.

FIG. 4 is a graph showing the relation between the outer diameter $d_1$ of the conductor and the capacitance with the relative dielectric constant $\epsilon_1$ of the insulator used as a parameter. Here, the outer diameter of the insulator is 3.8 mm, and the relative dielectric constant of the sheath is 3.2. A glass braid is incorporated in the cable.

The result of this calculation indicates that, in order to obtain the capacitance of 80 pF/m, the combination of the outer diameter of the conductor and the relative dielectric constant of the insulator must be below the dotted line in FIG. 4. From the aspect of noise suppressing characteristics or properties, it is desirable to increase the outer diameter as much as possible. On the other hand, generally, the minimum of the relative dielectric constant of the insulator is 2.2 to 2.3.

In view of the above relations, it has been decided that the substantial relative dielectric constant of the insulator should be set so as to be 2.5, and the outer diameter of the conductor be set so as to be not more than 0.8 mm.

Next, considering the flammability of the ignition cable, there has been a demand that the conventional non-flame retardant insulator be replaced by a flame retardant insulator. Therefore, it has been decided to use the EPDM-type insulator material having a substantial relative dielectric constant of not more than 2.5 and also possessing favorable general physical properties.

The values of the physical properties of this flame-retardant EPDM-type insulator material are shown in Table 1. This insulator material is characterized in that, in order to keep the relative dielectric constant to not more than 2.5, a bromine-type flame retarder having a high flame retardant effect, antimony trioxide and zirconium oxide are used in combination, the amount of addition of this insulator material being limited to 5 to 20 parts by weight.

TABLE 1

(Flame-retardant EPDM insulator material)

| | Non-flame retardant EPDM | | Flame retardant EPDM | |
|---|---|---|---|---|
| BLEND | | | | |
| Base polymer | High ethylene | 100 | High ethylene | 100 |
| Filler | Hydrophobic talc | 20 | Hydrophobic talc | 10 |
| Vulcanizer | Peroxide | 0.01 mol | Peroxide | 0.01 mol |
| Flame retarder | None | — | Metal oxide plus halogen | 35 |
| Others | Anti-aging and other assistants | small amount | Anti-aging and other assistants | small amount |
| PROPERTIES | | | | |
| Hardness (JISA) | 70 | | 72 | |
| Tensile strength | 90 kgF/cm$^2$ | | 80 kgF/cm$^2$ | |
| Physical elongation | 400% | | 390% | |
| Dielectric constant (1 KHz) | 2.44 | | 2.51 | |
| Oxygen index | 23 | | 27 | |

In the above Table, "High ethylene" represents a polymer containing not less than 0.75 mol. % of ethylene, and "anti-aging" means an anti-aging agent.

The noise suppressing properties of the high-tension resistance cable now will be described. Factors in the determination of the noise-suppressing properties include the electric circuit and the magnetic circuit. With respect to the electric circuit, the magnitude of noise waves generated when the ignition is caused by a spark plug is represented by a radiation power P expressed by the following formula (2):

$$P = I \cdot E = \frac{E^2}{Z} \tag{2}$$

where I represents electric current, E represents applied voltage, and Z represents impedance.

In formula (2), since the applied voltage E is increased year after year, increase of the impedance Z decreases the radiation power P. The impedance Z is represented by the following formula (3):

$$Z = R + j\left(\omega L - \frac{1}{\omega C}\right) = \sqrt{R^2 + \left(\omega L - \frac{1}{\omega C}\right)^2} \tag{3}$$

where R represents resistance, L represents inductance, C represents capacitance, and $\omega$ represents the frequency.

Since R, C and $\omega$ are limited elements it is necessary to increase the inductance L. The inductance L is represented by the following formula (4):

$$L = \alpha \cdot \mu \cdot \pi \cdot a^2 \frac{N^2}{l} \tag{4}$$

where $\alpha$ represents Nagaoka's factor, $\mu$ represents the permeability of the magnetic material of the conductor, a represents the radius of the magnetic material of the conductor, and N represents the total number of turns of the metal resistance wire, and is the total length.

Because of the nature of the construction of the cable, a and N are limited, and therefore the use of the magnetic material of the conductor having a high permeability $\mu$ decreases the radiation power P which is the noise source.

On the other hand, with respect to the noise suppression because of the magnetic circuit, this is controlled by a Joule heat exchange (loss) which converts electrical energy into thermal energy. This can be represented by the sum of an eddy current loss Pe, a hysteresis loss Ph and an iron loss (relative loss coefficient) inherent to the magnetic material. In order to achieve the noise suppression, it is effective to increase the factors represented respectively by the following formulas (5), (6) and (7).

$$Pe = \frac{\pi^2 \cdot t^2 \cdot f^2}{6} \cdot \frac{Bm^2}{\rho} \tag{5}$$

$$\text{Ph (hysteresis loss)} = f \cdot \eta \cdot Bm^{1.6} \tag{6}$$

$$\text{Relative loss coefficient: } Tan\ \delta/\mu i \tag{7}$$

where t represents the thickness of the magnetic material of the conductor, $\rho$ represents the specific resistance of the magnetic material of the conductor, Bm represents the maximum magnetic flux density, f represents the frequency, and h represents the hysteresis loss coefficient.

In view of the foregoing, it is preferred that a magnetic powder added to a limited space should meet the following requirements:

(1) high permeability;
(2) high magnetic flux density (high effective saturated magnetic flux density);
(3) high hysteresis loss coefficient; and
(4) high relative loss coefficient Various properties of examples of the magnetic powder studied here are shown in Table 2.

TABLE 2

| | | | (Properties of magnetic powder) | | | | |
|---|---|---|---|---|---|---|---|
| | | | 1 | 2 | 3 | 4 | 5 |
| AC initial permeability | μiac | — | 2500 | 3500 | 4000 | 5000 | 7000 |
| Saturated flux density | Bs | Gauss | 4700 | 4000 | 4400 | 4500 | 5000 |
| Residual flux density | Br | Gauss | — | — | 1500 | 1500 | 2000 |
| Hysteresis loss coefficient | η | $\times 10^{-6}$/mJ | — | — | 1.0 | 1.0 | 1.0 |
| Relative loss coefficient | tan δ/μi | $\times 10^{-6}$ | 7 | 20 | 15 | 40 | 50 |
| Specific resistance | ρ | Ω-cm | 50 | 2 | 20 | 10 | 5 |

What is important for the ferrite core is the combination of the above-mentioned high-permeability magnetic powder and the base polymer to which large parts of this magnetic powder can be added.

Table 3 shows results of various tests of ferrite cores (0.8 mm in outer diameter) formed by adding a suitable amount of a magnetic material to silicone rubber and/or fluororubber, and then by extruding and vulcanizing it onto Kevlar (tm) fibers.

TABLE 3

| | | | (Properties of magnetic materials) | | | | | | | | | |
|---|---|---|---|---|---|---|---|---|---|---|---|---|
| Items | | | A | B | C | D | E | F | G | H | I | J |
| Materials | Base polymer | Silicone rubber | 100 | 100 | 100 | 100 | 100 | | | | | |
| | | Fluororubber | | | | | | 100 | 100 | 100 | 100 | 100 |
| | Magnetic powder | ① | 200 | | | | | | 200 | | | |
| | | ② | | 200 | | | | | | 200 | | |
| | | ③ | | | 200 | | | | | | 200 | |
| | | ④ | | | | 200 | | | | | | 200 |
| | | ⑤ | | | | | 200 | | | | | |

TABLE 3-continued (Properties of magnetic materials)

| | | | | | | | | | | | |
|---|---|---|---|---|---|---|---|---|---|---|---|
| | Vulcanizer and others | | small | small | small | small | small | small | small | small | small | small |
| Property | * High-temp. | 250° C. X after 24 Hr | ○ | ○ | ○ | ○ | ○ | ○ | ○ | ○ | ○ | ○ |
| | | 250° C. X after 24 Hr | X | X | X | X | X | ○ | ○ | ○ | ○ | ○ |
| | Low-temp. | 0° C. X after 2 Hr | ○ | ○ | ○ | ○ | ○ | Δ | Δ | Δ | Δ | Δ |
| | | −20° C. X after 2 Hr | ○ | ○ | ○ | ○ | ○ | X | X | X | X | X |
| | Flexing Resistance** | 1000 times | ○ | ○ | ○ | ○ | ○ | ○ | ○ | ○ | ○ | ○ |
| | Self-extinguishing | | Δ | Δ | Δ | Δ | Δ | ○ | ○ | ○ | ○ | ○ |
| | Items | | K | L | M | N | O | P | Q | R | S | T |
| Materials | Base polymer | Silicone rubber | | 90 | 90 | 50 | 50 | 30 | 30 | 70 | 70 | 70 |
| | | Fluororubber | 100 | 10 | 10 | 50 | 50 | 70 | 70 | 30 | 30 | 30 |
| | Magnetic powder | ① | | 200 | | 200 | | 200 | | | | |
| | | ② | | | | | | | | 200 | 400 | 600 |
| | | ③ | | | | | | | | | | |
| | | ④ | | | | | | | | | | |
| | | ⑤ | 200 | | 200 | | 200 | | 200 | | | |
| | Vulcanizer and others | | small | small | small | small | small | small | small | small | small | small |
| Property | * High-temp. | 250° C. X after 24 Hr | ○ | ○ | ○ | ○ | ○ | ○ | ○ | ○ | ○ | ○ |
| | | 250° C. X after 24 Hr | ○ | ○ | ○ | ○ | ○ | ○ | ○ | ○ | ○ | ○ |
| | Low-temp. | 0° C. X after 2 Hr | Δ | ○ | ○ | ○ | ○ | Δ | Δ | ○ | ○ | ○ |
| | | −20° C. X after 2 Hr | X | ○ | ○ | ○ | ○ | X | X | ○ | ○ | ○ |
| | Flexing Resistance** | 1000 times | ○ | ○ | ○ | ○ | ○ | ○ | ○ | ○ | ○ | X |
| | Self-extinguishing | | ○ | ○ | ○ | ○ | ○ | ○ | ○ | ○ | ○ | ○ |

○: No abnormality such as crack, and self-extinguishing ability;
Δ: slight crack
X: abnormality such as crack, and no self-extinguishing ability.
*In the winding test, the ferrite core with an outer diameter of 0.8 mm was wound around a round pin with an outer diameter of 2 mm, and a weight of 500 g was suspended from the end of the winding so as to determine whether any rupture developed.
**In the flexing resistance test, a weight of 500 g was also suspended from the end of the ferrite core with an outer diameter of 0.8 mm, and the ferrite core was held between two round pins each having an outer diameter of 2 mm, and the ferrite core was bent through 180° at a frequency of 60 per minute so as to determine whether any crack developed.

As can be seen from the above results, with respect to the thermal resistance, the fluororubber ferrites have the advantage that they are soft and not flammable even at 250° C.; however, they also have the disadvantage that, in the cold-temperature winding test carried out at around 0° C. they become subject to cracking.

Therefore, it is effective to blend silicone rubber, having excellent cold-temperature resistance, with fluororubber. The silicone rubber also has a feature that a large amount of the magnetic powder can be added to the silicone rubber.

As a result, it has been found that ferrite cores having excellent properties and processability can be produced according to a procedure in which silicone rubber (Toray: SH432) and fluororubber (JSR: Afras) are blended together in a weight ratio of 4:6 to 1:9 as the base material for the ferrite core. 200 to 400 parts by weight of Mn-Zn ferrite (magnetic powder), having a particle size of not more than 10 μm, an AC (alternating current) initial permeability of not less than 2500 and a saturated flux density of not less than 4000 Gauss, was added to the above blend, and a small amount of the vulcanizer also was added.

One factor which arises because of the noise suppressing properties is the volume specific resistivity of the ferrite core.

Table 4 shows such volume specific resistivity and magnetic effects examined with respect to ferrite cores to which various kinds of electrically-conductive carbon were added.

TABLE 4

(Effects of conductive carbon in magnetic material)

| | | | Blend No. | | | | | | | | | |
|---|---|---|---|---|---|---|---|---|---|---|---|---|
| | Items | | a | b | c | d | e | f | g | h | i | j |
| MATERIAL | Base polymer | Silicone rubber | 70 | 70 | 70 | 70 | 70 | 70 | 70 | 70 | 70 | 70 |
| | | Fluoro rubber | 30 | 30 | 30 | 30 | 30 | 30 | 30 | 30 | 30 | 30 |
| | Magnetic powder/2 | | 200 | 200 | 200 | 200 | 200 | 200 | 200 | 200 | 200 | 400 |
| | Conductive carbon | VGCF | 0 | 5 | 10 | 20 | 30 | | | | | 30 |
| | | PAN type | | | | | | 5 | 30 | | | |
| | | PITCH type | | | | | | | | 5 | 30 | |
| | Vulcanizer and others | | small | small | small | small | small | small | small | small | small | small |

TABLE 4-continued

| Items | (Effects of conductive carbon in magnetic material) Blend No. a | b | c | d | e | f | g | h | i | j |
|---|---|---|---|---|---|---|---|---|---|---|
| *[1]Volume specific | $1 \times 10^{15}$ | $5 \times 10^{12}$ | $1 \times 10^{10}$ | $9 \times 10^{8}$ | $1 \times 10^{8}$ | $1 \times 10^{13}$ | $5 \times 10^{9}$ | $2 \times 10^{13}$ | $7 \times 10^{9}$ | $1 \times 10^{13}$ |

*[1]Measured in terms of 1 mm-thick sheet.

As can be seen from the results in Table 4, the volume specific resistivity can be decreased by adding 5 to 20 parts by weight of vapor grown carbon fibers (electrically-conductive carbon). It also is effective in the reduction of the eddy current loss Pe. A good thermal conductivity possessed by the linear fibers facilitates the Joule heat exchange (ii) of the noise suppressing properties, thereby improving those properties.

Thus, one of the features of the ignition cable of the present invention is not merely the decrease in the volume specific resistance, but also the use of electrically-conductive carbon having an excellent thermal conductivity coefficient. These features are set forth in Table 5.

Figure 5:
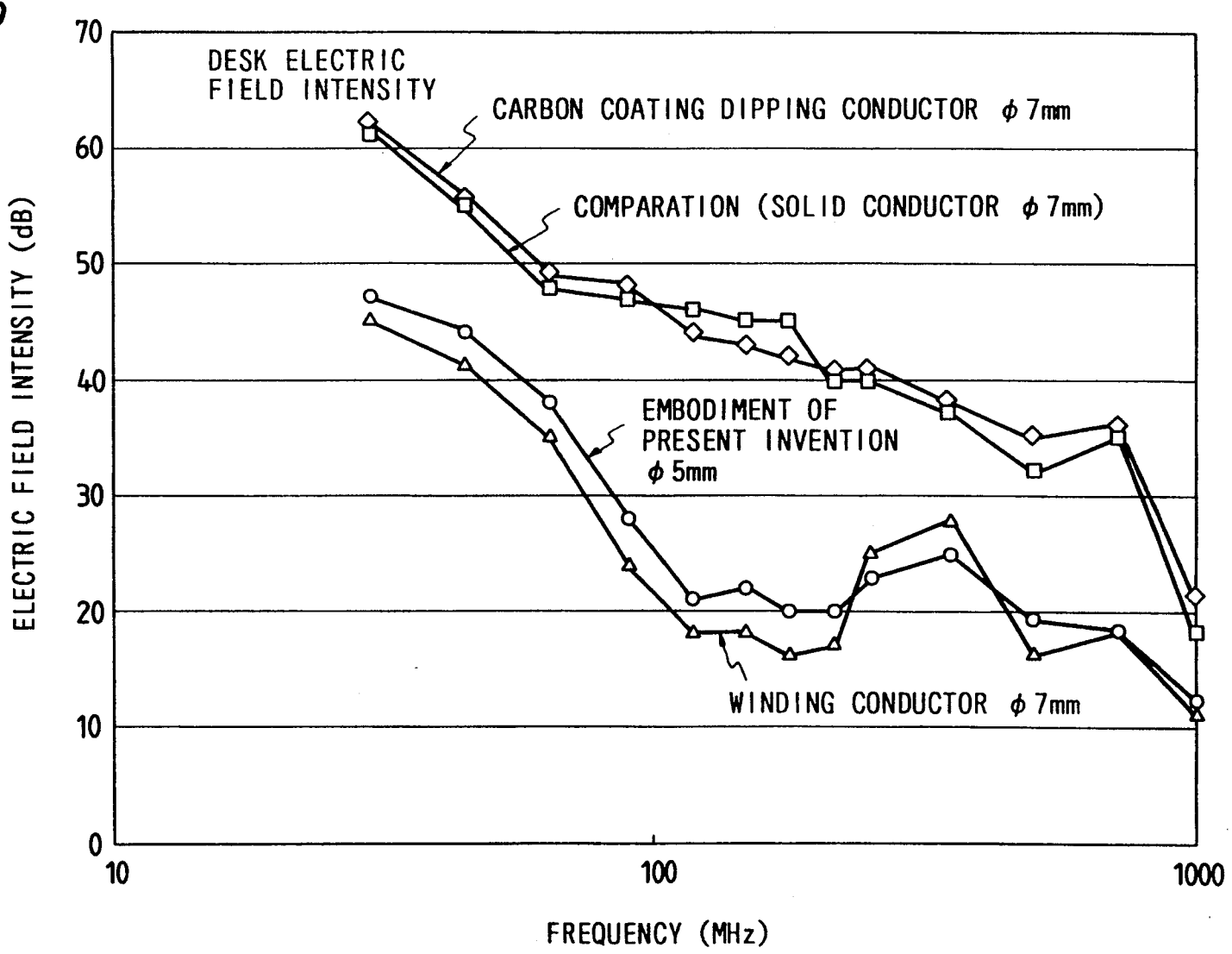

FIG. 5 shows the comparison in property values and desk electric field intensity between the ignition cable of the invention and a conventional cable.

While the invention has been described in detail above with reference to a preferred embodiment, various modifications within the scope and spirit of the invention will be apparent to people of working skill in this technological field. Thus, the invention should be considered as limited only by the scope of the appended claims.

TABLE 5

| Items | (Properties of Example of the Invention) Method and conditions | Example | Comparative Example |
|---|---|---|---|
| Resistivity (KΩ/m) | Wheatstone bridge | 9 (L ~ T) | 5 (Å ~ E) |
| Voltage resistance (kV) | DC. 5kV/30 min. voltage increase | 49 | 59 |
| Capacitance (pF/m) | LCR meter method | 78 (5 mm ϕ) | 78 (7 mm ϕ) |
| High-temperature | 120° C. × 120 h. resistivity change | +1.2% | −20% |
| Low-temperature | −30° C. × 48 h. resistivity change | +0.21% | +7% |
| Spark resistance | 120° C. × 2000 Hr 30 KVP resistivity change | −1.2% | −24% |

What is claimed is:

1. A noise suppressing high-tension resistance cable comprising:

a resistance conductor having an outer diameter not greater than 0.8 mm, a resistivity of substantially 16 kΩ/m and a capacitance of not more than 80 pF/m, said resistance conductor including a reinforcement core, a ferrite core layer formed on said reinforcement core, and a metal winding layer, said metal winding layer being formed of a plurality of wires helically wound at a predetermined pitch around said ferrite core layer, wherein said ferrite core layer contains a base material made of silicone rubber and fluororubber blended together in a weight ratio of 4:6 to 1:9, 200 to 400 parts by weight of one or more kinds of Mn-Zn type ferrite powder being added to 100 parts by weight of said base material;

an insulator layer formed on said resistance conductor;

a reinforcement layer formed on said insulator layer; and a sheath layer formed on said reinforcement layer;

wherein an overall outer diameter of said cable is not greater than 5 mm.

2. A noise suppressing high-tension resistance cable as claimed in claim 1, wherein said ferrite core is formed by extrusion.

3. A noise suppressing high-tension resistance cable as claimed in claim 1, wherein said reinforcement layer is made of braided glass fibers having a density of 5 to 9 meshes per inch.

4. A noise suppressing high-tension resistance cable as claimed in claim 1, wherein an outer diameter of said reinforcement core is between 0.4 to 0.45 mm.

5. A noise suppressing high-tension resistance cable according to claim 1, wherein said ferrite core have a particle size of not more than 100 μm, an AC initial permeability of not less than 2500, a saturated flux density of not less than 4000 Gauss, and a relative loss coefficient of not less than $4 \times 10^{-6}$.

6. A noise suppressing high-tension resistance cable as claimed in claim 1 wherein said ferrite core layer further contains not more than 20 parts by weight of carbon fiber (preferably, vapor grown carbon fiber) added to 100 parts by weight of said base material.

7. A noise suppressing high-tension resistance cable as claimed in claim 1, wherein said wires have an outer diameter of 0.04 to 0.045 mm, and are wound 91 to 115 turns per centimeter around said ferrite core layer.

8. A noise suppressing high-tension resistance cable as claimed in claim 1, wherein said insulator layer, containing a flame-retardant EPDM having a dielectric constant of not more that 2.54, is extrusion-coated on said resistance conductor.

9. A noise suppressing high tension resistance cable as claimed claim 7, wherein an outer diameter of said insulator layer is not more than 3.8 mm.

* * * * *